United States Patent [19]

Knoblauch

[11] Patent Number: 4,512,467

[45] Date of Patent: Apr. 23, 1985

[54] DRILL-BIT INDEX CASE

[75] Inventor: Georg Knoblauch, Giengen, Fed. Rep. of Germany

[73] Assignee: Georg Knoblauch GmbH, Giengen/Brenz, Fed. Rep. of Germany

[21] Appl. No.: 581,082

[22] Filed: Feb. 17, 1984

[30] Foreign Application Priority Data

Feb. 22, 1983 [DE] Fed. Rep. of Germany ..... 8304781

[51] Int. Cl.[3] ..... B65D 85/24

[52] U.S. Cl. ..... 206/379; 206/45.13; 206/372; 312/DIG. 33

[58] Field of Search ..... 206/349, 372, 373, 379, 206/45.13; 312/DIG. 33, 272.5, 275, 276, 306, 305, 325, 326, 327; 217/58, 60 E, 60 R; 220/335

[56] References Cited

U.S. PATENT DOCUMENTS

| | | | |
|---|---|---|---|
| 2,226,693 | 12/1940 | Bruno | 312/DIG. 33 |
| 2,775,342 | 12/1956 | Smith | 206/379 |
| 3,074,539 | 1/1963 | Rogovin | 206/379 |
| 4,006,821 | 2/1977 | Sautter | 312/DIG. 33 |
| 4,236,746 | 12/1980 | Lavoie | 220/335 |

FOREIGN PATENT DOCUMENTS

| | | | |
|---|---|---|---|
| 2446504 | 2/1976 | Fed. Rep. of Germany | 206/379 |
| 1551250 | 8/1979 | United Kingdom | 206/379 |

*Primary Examiner*—William T. Dixson, Jr.

*Assistant Examiner*—Jimmy G. Foster

*Attorney, Agent, or Firm*—Karl F. Ross; Herbert Dubno

[57] ABSTRACT

A case for holding and displaying objects such as drill bits has an elongated and upwardly open box, an insert adapted to hold a plurality of the objects and pivotal in the box about an insert axis between a down position wholly contained therein and an up position projecting upward therefrom, a U-shaped link having a pair of legs pivoted on the insert and a straight bight portion extending substantially parallel to the axis, interconnecting the legs, and of a predetermined bight length between the legs, and a lid pivotal on the box between a closed position engaging over and closing the box and an open position projecting upward therefrom. The lid is formed with a pivot loop through which the bight portion passes and which has a pair of outer edges spaced axially apart substantially by the bight length. Thus the bight portion engaged through this loop cannot move axially relative to the lid. The lid is further formed with a window at the pivot link having a pair of outer edges spaced apart parallel to the axis by a distance greater than the bight length and with a strut bridging the window parallel to and between the window edges so that the bight portion engages against the strut on closing of the lid. A cover plate has respective snap tabs spaced apart axially by a distance greater than the bight length and engaged snugly against the window edges.

8 Claims, 4 Drawing Figures

DRILL-BIT INDEX CASE

FIELD OF THE INVENTION

The present invention relates to a container for storing and displaying elongated objects. More particularly this invention concerns a case for drill bits and the like.

BACKGROUND OF THE INVENTION

It is standard practice to store elongated objects such as twist drills, auger bits, and the like in a case which contains them safely during transport but which allows these objects to be displayed for easy selection, removal, and replacement. Such a case normally has an elongated and upwardly open box, an insert adapted to hold a plurality of the objects and pivotal in the box between a down position wholly contained therein and an up position projecting upward therefrom, and a lid pivotal on the box between a closed position engaging over and closing the box and an open position projecting upward therefrom. A U-shaped link has a bight portion looped through a pivot eye stamped out of the lid and a pair of legs whose ends are pivoted on the insert for angular movement of the insert into the up position on displacement of the lid from the closed into the open position. A cover plate releasably engaged with the lid over the window thereof closes the hole in the lid where the pivot tabs have been stamped out.

This cover plate normally can carry indicia concerning the contents of the case and/or the manufacturer of the case. The pivot loop is typically a narrow strip of metal stamped out of the material of the lid and the bight portion of the link is either of the same width as it or of substantilly greater width. When of greater width this bight portion can catch on the snap feet of the cover plate and, when thus caught, can push the cover plate off when the case is closed. When of the same length the link pushes on closing of the case exclusively against the cover plate which eventually loosens and falls off, in which case the case no longer works properly, as on closing the link pokes back through the lid and jams.

OBJECTS OF THE INVENTION

It is therefore an object of the present invention to provide an improved case for holding and displaying elongated objects.

Another object is the provision of such a case for holding and displaying elongated objects which overcomes the above-given disadvantages, that is which automatically opens out and closes down without eventually jamming or otherwise failing.

SUMMARY OF THE INVENTION

A case for holding and displaying objects such as drill bits according to the invention has an elongated and upwardly open box, an insert adapted to hold a plurality of the objects and pivotal in the box about an insert axis between a down position wholly contained therein and an up position projecting upward therefrom, a U-shaped link having a pair of legs pivoted on the insert and a straight bight portion extending substantially parallel to the axis, interconnecting the legs, and of a predetermined bight length between the legs, and a lid pivotal on the box between a closed position engaging over and closing the box and an open position projecting upward therefrom. The lid is formed with a pivot loop through which the bight portion passes and which has a pair of outer edges spaced axially apart substantially by the bight length. Thus the bight portion cannot move axially relative to the lid. The lid is further formed with a window at the pivot link having a pair of outer edges spaced apart parallel to the axis by a distance greater than the bight length and with a strut bridging the window parallel to and between the window edges so that the bight portion engages against the strut on closing of the lid. A cover plate has respective snap tabs spaced apart axially by a distance greater than the bight length and engaged snugly against the window edges.

With the system of this invention, therefore, the link cannot move axially in the pivot loop and it is narrower than the tabs of the cover plate, so it cannot jam. In addition on closing the bight will push back against the strut, thereby not actually touching the cover plate so same will not be pushed loose, and so that in fact even if the cover plate is lost the case will open and close properly.

According to this invention the lid and the strut are generally coplanar. In addition the lid is formed of sheet material and the loop and lid are unitary. The loop is formed by at least one arcuate strip of the sheet material of the lid. In fact according to the invention the loop is formed by two such loops that flank the strut and the window is formed of two parts respectively receiving the tabs and flanking the strut also.

The legs of the link according to the invention have front ends pivoted on the insert at an axis parallel to the insert axis. Furthermore, the snap tabs are barbed and the cover plate is limitedly elastically deformable.

DESCRIPTION OF THE DRAWING

The above and other features and advantages will become more readily apparent from the following, reference being made to the accompanying drawing in which.

SPECIFIC DESCRIPTION

Figure 1:
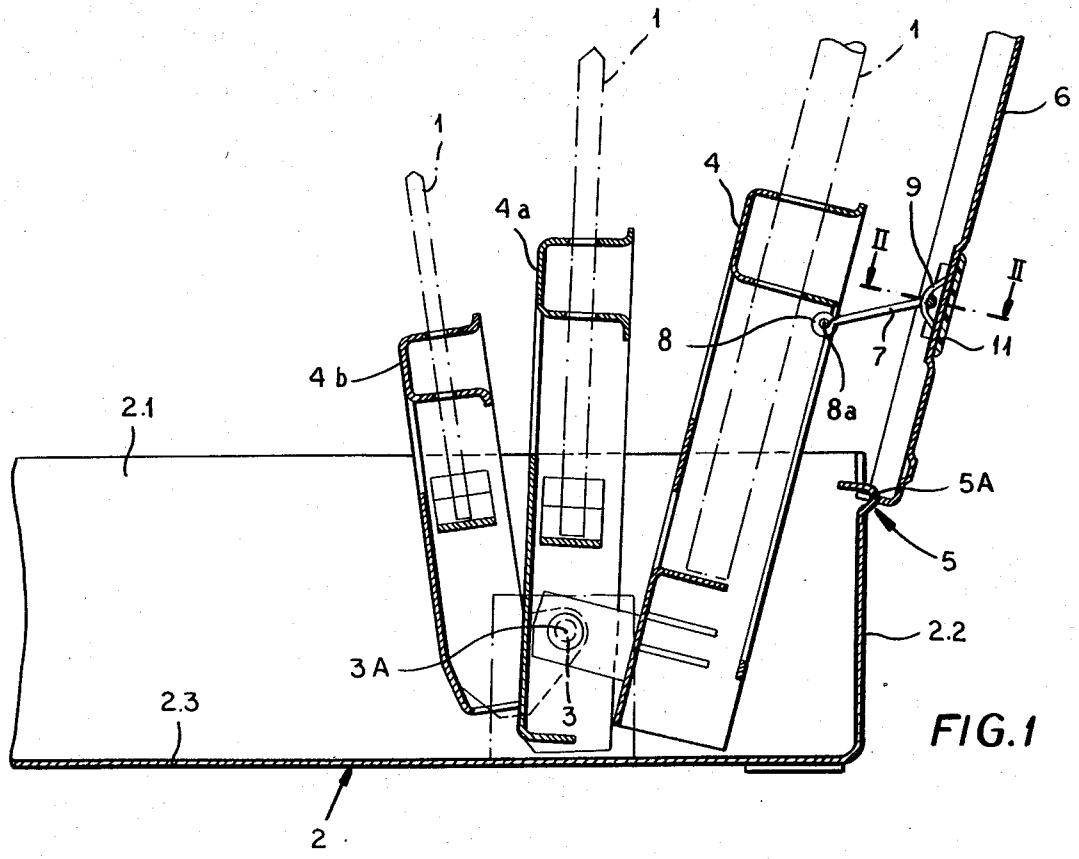
FIG. 1 is a longitudinal section through the drill case according to this invention.

As seen in FIG. 1 a drill-bit index case according to this invention has a parallepipedal sheet-metal box 2 having side walls 2.1 supporting pivots 3 defining an axis 3A on which a rear insert 4, a middle insert **4*a*, and a front insert 4*b* are pivoted in standard fashion, so that when the rear insert 4 is pivoted back into the illustrated upright position the other two inserts 4*a* and 4*b* are similarly erected. These inserts 4, 4*a*, and 4*b* are perforated to hold respective groups of twist drill bits 1 as is also well known in the art. In addition, the inserts 4 can lie down inside the box 2, with the front insert 4*b* lying flat on the floor 2.3 of the box, the middle insert 4*a* lying atop the insert 4*b*, and the insert 4 lying atop the insert 4*a*. Appropriate spacers not illustrated here are provided to prevent the bits 1 from sliding out of the inserts 4, 4*a*, and 4*b*** in this down position.

Figure 2:
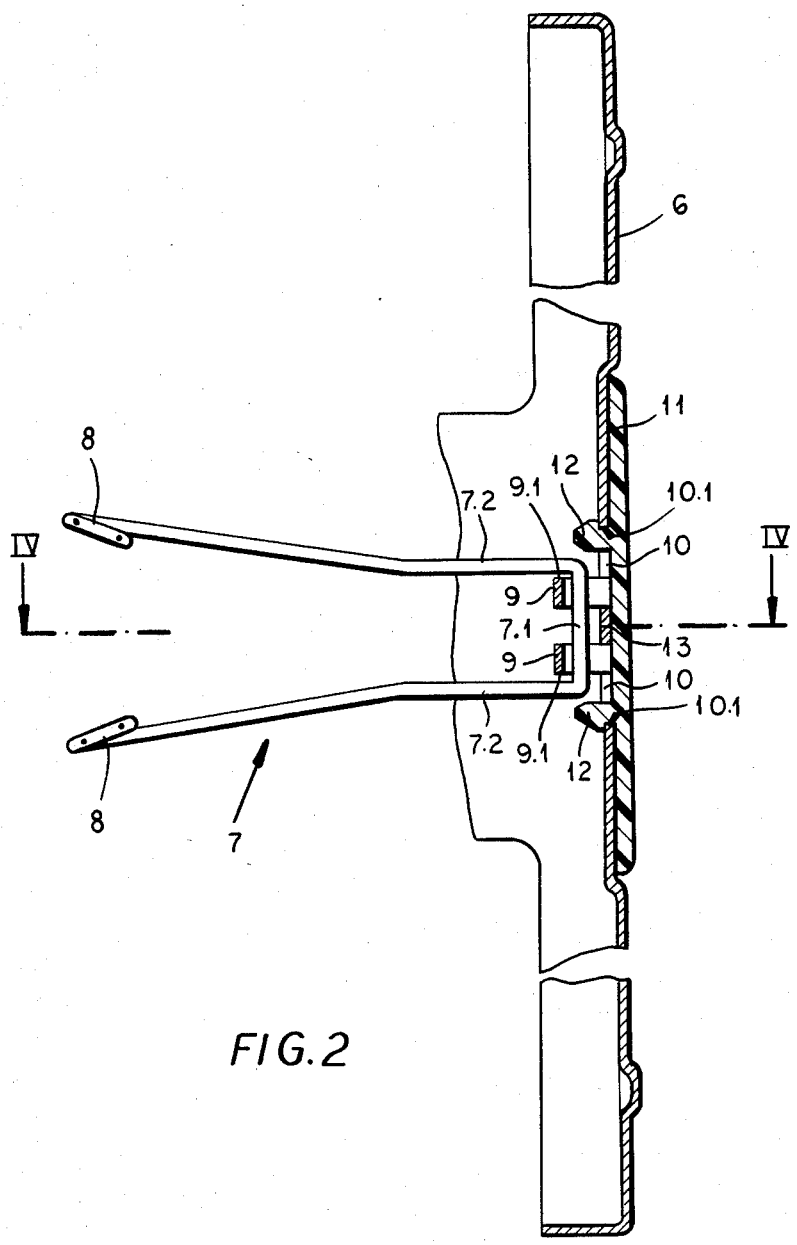
FIG. 2 is a large-scale sectional view taken along line II—II of FIG. 1.
Figure 3:
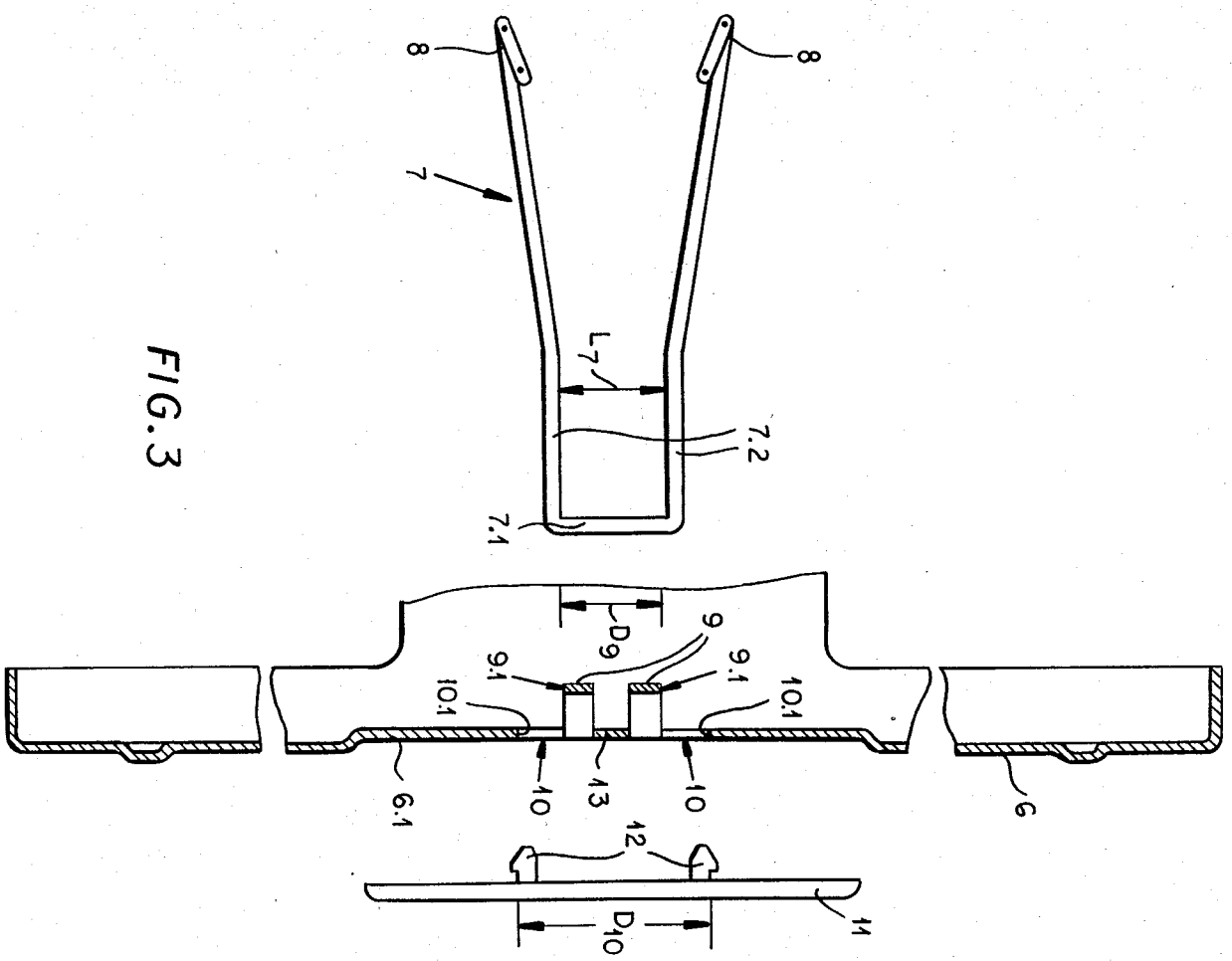
FIG. 3 is an exploded view of the structure of FIG. 2.
Figure 4:
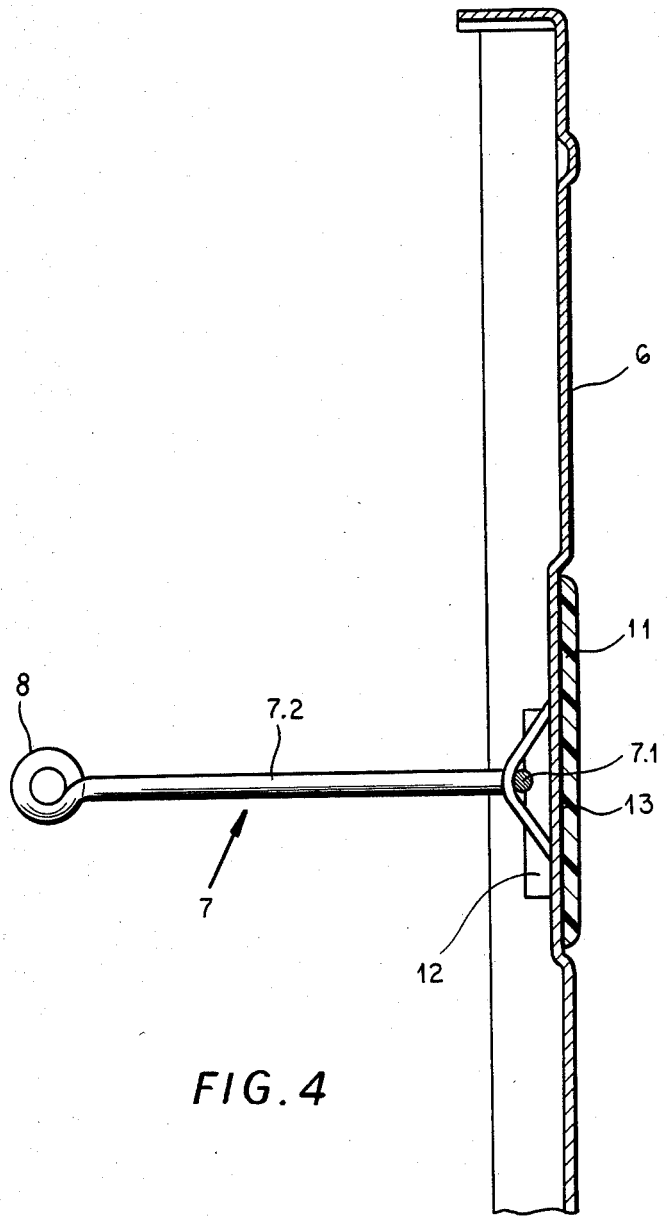
FIG. 4 is a section taken along line IV—IV of FIG. 2.

The box 2 further has a rear wall 2.2 formed with an integral pivot 5 defining a pivot axis 5A parallel to the axis 3A for a sheet-metal lid 6 that can be closed down over the box 2 to contain the inserts 4, **4*a*, and 4*b* and the respective bits 1** when they are in the abovedescribed down position. As best seen in FIGS. 2 through 4 this lid 6 is formed with a two-part window 10 having a pair of parallel outer edges 10.1 that extend in planes perpendicular to the axes 3A and 5*a* and that are spaced apart parallel to these axes by a distance $D_{10}$. This window 10 is formed by stamping out two pivot straps 9 that extend perpendicular to the axes 3A and 5A and that have outer edges 9.1 spaced apart by a distance $D_9$ that is substantially shorter than the distance $D_{10}$. Between these two stamped-out pivot straps 9 a web or strut 13 is left which lies in the plane of the surrounding portions of the lid 6.

A cover plate 11 that is big enough to cover both parts of the window 10 is formed with two snap tabs 12 that are outwardly barbed and spaced apart by the distance $D_{10}$ so that this plate 11 can be snapped into place over the window 10. Typically this plate 11 is made of a synthetic resin so that it not only has sufficient flexibility to deform and snap into place, but that it can readily be embossed to bear appropriate indicia regarding the manufacturer or the contents of the case. In addition the center of the lid 6 is normally formed with a recess 6.1 around the window 10 that receives this plate 11, so its outer surface is generally flush with that of the lid 2 as seen in FIG. 2.

A steel U-shaped link wire 7 has a straight bight 7.1 and a pair of legs 7.2. The bight 7.1 is of a length $L_7$ between the legs 7.2 which is shorter than the distance $D_{10}$ and just slightly longer than the distance $D_9$. This bight 7.1 is looped through the two pivot straps 9 so that the two legs 7.2 closely flank the outer edges 9.1 as best seen in FIG. 2. This effectively captures the link 7 so that it cannot move at the lid 6 axially enough to touch the snap tabs 12.

The front ends of the legs 7.2 are formed as eyes 8 that are pivoted at an axis 8A on the rear insert 4, which axis 8A is parallel to the axes 3A and 5A. Thus when the lid 6 is lifted up as shown in FIG. 1, the link 7 will pivot from a position parallel to the insert 4 to a position transverse thereto, pulling this insert 4 and the other two inserts 4*a* and 4*b* into the illustrated up position.

To close the case the lid 6 is pivoted back down. This action pushes the bight 7.1 back against the strut 13 so that force is transmitted directly between this integral strut 13 through the link to the rear insert 4. Unlike prior-art systems, the link 7 does not bear on the cover plate 11 at all. In fact this cover plate never even touches the bight 7, so that the case continues to function normally even without the cover plate 11.

Thus the cover plate 11 according to this invention cannot be knocked off by the link 7, as this link 7 never touches it. Force transmission between the lid 6 and the link 7 is direct to the insert 4. On opening the link 7 pulls against the integral pivot straps, and on closing it pushes against the integral web or strut 13.

I claim:

1. A case for holding and displaying objects such as drill bits, the case comprising:

an elongated and upwardly open box;

an insert adapted to hold a plurality of the objects and pivotal in the box about an insert axis between a down position wholly contained therein and an up position projecting upward therefrom;

a U-shaped link having a pair of legs pivoted on the insert and a straight bight portion extending substantially parallel to the axis, interconnecting the legs, and of a predetermined bight length between the legs;

a lid pivotal on the box between a closed position engaging over and closing the box and an open position projecting upward therefrom, the lid being formed with a pivot loop through which the bight portion passes and which has a pair of outer edges spaced axially apart substantially by the bight length, whereby the bight portion cannot move axially relative to the lid, a window at the pivot link having a pair of outer edges spaced apart parallel to the axis by a distance greater than the bight length, and a strut bridging the window parallel to and between the window edges, whereby the bight portion engages against the strut on closing of the lid; and a cover plate having respective snap tabs spaced apart axially by a distance greater than the bight length and engaged snugly against the window edges.

2. The case defined in claim 1 wherein the lid and the strut are generally coplanar.

3. The case defined in claim 1 wherein the lid is formed of sheet material and the loop and lid are unitary, the loop being formed by at least one arcuate strip of the sheet material of the lid.

4. The case defined in claim 3 wherein the loop is formed by two such loops that flank the strut, the window being of two parts respectively receiving the tabs and flanking the strut also.

5. The case defined in claim 1 wherein the legs of the link have front ends pivoted on the insert at an axis parallel to the insert axis.

6. The case defined in claim 1 wherein the snap tabs are barbed and the cover plate is limitedly elastically deformable.

7. The case defined in claim 6 wherein the box and lid are of sheet metal and the cover plate is of a synthetic resin.

8. The case defined in claim 1 wherein the legs of the link extend perpendicularly from the bight thereof.

* * * * *